United States Patent [19]

de Pingon

[11] 4,329,796

[45] May 18, 1982

[54] MULTI-USE EXCAVATING AND LOAD HANDLING MACHINE

[76] Inventor: Pierre J. de Pingon, 7 Ave. du Parmelan, 74000 Annecy, France

[21] Appl. No.: 185,916

[22] PCT Filed: May 8, 1979

[86] PCT No.: PCT/FR79/00041

§ 371 Date: Jan. 16, 1980

§ 102(e) Date: Jan. 16, 1980

[87] PCT Pub. No.: WO79/01075

PCT Pub. Date: Dec. 13, 1979

[51] Int. Cl.[3] ..... E02F 3/76

[52] U.S. Cl. ..... 37/117.5; 180/6.58; 280/765; 414/695

[58] Field of Search ..... 37/103, 117.5, 118 R, 37/118 A; 212/245, 247, 248, 223; 414/685–687, 722, 695, 738; 180/6.58; 280/763–765

[56] References Cited

U.S. PATENT DOCUMENTS

| | | | |
|---|---|---|---|
| 2,295,769 | 9/1942 | Zeilman | 212/245 |
| 2,602,552 | 7/1952 | Orloff | 212/245 |
| 3,003,649 | 10/1961 | Przybylski | 212/248 |
| 3,034,670 | 5/1962 | Lafian | 212/247 X |
| 3,107,799 | 10/1963 | Briscoe et al. | 414/695 X |
| 3,589,538 | 6/1971 | Menzi | 37/103 X |
| 3,606,047 | 9/1971 | Schaeff | 37/103 X |
| 3,777,919 | 12/1973 | Konijn | 280/764 X |
| 3,958,813 | 5/1976 | Carey | 280/765 X |
| 4,049,070 | 9/1977 | Soyland | 37/103 X |
| 4,183,711 | 1/1980 | Schaeff | 414/687 X |
| 4,241,803 | 12/1980 | Lauber | 280/765 X |

FOREIGN PATENT DOCUMENTS

| | | | |
|---|---|---|---|
| 1275478 | 8/1968 | Fed. Rep. of Germany | 37/117.5 |
| 1756641 | 6/1971 | Fed. Rep. of Germany | 37/103 |
| 2101058 | 2/1972 | Fed. Rep. of Germany | 37/103 |
| 2355866 | 5/1974 | Fed. Rep. of Germany | 37/117.5 |
| 1147303 | 11/1957 | France | 37/103 |
| 1175925 | 4/1959 | France | 37/103 |
| 1522045 | 3/1968 | France | 37/103 |
| 1519756 | 4/1968 | France | 37/103 |
| 2094901 | 2/1972 | France | 37/103 |
| 2119559 | 8/1972 | France | 37/103 |
| 2264681 | 10/1975 | France | 37/103 |
| 569715 | 11/1957 | Italy | 37/103 |
| 1023073 | 3/1966 | United Kingdom | 37/103 |
| 261993 | 5/1970 | U.S.S.R. | 37/117.5 |
| 492632 | 2/1976 | U.S.S.R. | 37/103 |

*Primary Examiner*—E. H. Eickholt
*Attorney, Agent, or Firm*—Young & Thompson

[57] ABSTRACT

This machine comprises a chassis which bears at one end a motor unit for driving large size drive wheels whereby said chassis rests on the ground at this end. At its other end, the chassis is provided with retractable supports by which it may rest on the ground. This end also carries a turret mounted on the chassis by an orientation ring and supporting the cabin. A working assembly is articulated on this turret immediately above the orientation ring in such a way as to be subjected to vertical clearance swinging movement by passing beside the cabin. Arms associated with jacks and supporting steering wheels are also articulated on this cabin. When the cabin is facing forward, the cabin and motor unit are disposed on one side of the longitudinal axis of the machine, while the working assembly is disposed on the other side of that longitudinal axis.

8 Claims, 4 Drawing Figures

MULTI-USE EXCAVATING AND LOAD HANDLING MACHINE

The present invention generally relates to excavating and load handling or loading machines.

Mobile excavators are generally constituted by a carrying chassis equipped with four single- or dual-type wheels and by a turret mounted on said chassis and carrying the working attachments and the driver's cab.

However, this solution is cumbersome; as the turret rotates above the tires and carries the cab, the minimum height of the machine is not compatible with the dimensions and functions thereof. In addition, this unnecessarily raises the point of articulation of the excavating attachment on the machine, reducing the depth of working by as much.

Other machines called "backhoe loaders" also exist, which are constituted by a chassis similar to those of agricultural tractors, carrying at the front a loading attachment and, to the rear, an excavator attachment. Such a solution is very widely adopted, but it gives a mediocre result and has numerous drawbacks, such as: the inefficiency of the attachments, the necessity of providing two attachments for similar functions, a low loading height, a limited rotation of the excavator attachment, the impossibility of providing a crane attachment on the machine, and the application of too great a load on the steering axle when the machine is working as a loader.

It is an object of the invention to create a mutli-use machine not having the drawbacks of the existing machines and furnishing, for minimum dimensions in height and in length, a maximum of possibilities, whilst comprising one sole attachment that may work as loader, excavator and crane, the arrangement being further such so as to allow a total rotation of the excavator and crane attachment and to ensure a good distribution of the load on the driving wheels when the machine works as a loader and for transporting loads.

To this end, the invention relates to a mutli-use excavating and load handling machine comprising a chassis carrying, towards one end, a power unit driving a driving axle equipped with driving wheels by which said chassis rests on the ground at this end, said chassis being provided towards its other end, with retractable stabilizers by which it may rest on the ground at this other end, said end carrying a turret mounted on the chassis via a slewing gear ring, this turret supporting the cab, a working attachment and a pair of retractable steering wheels.

According to a particular feature of the invention, the power unit is offset laterally with respect to the middle longitudinal axis of the chassis, and the working attachment is itself offset laterally with respect to the centre of the slewing gear ring of the turret, but opposite the offset of the power unit when this working attachment is directed towards this power unit, so that, for transport, the working attachment may be lowered with respect to the chassis, coming to the side of the power unit. The cab provided on the turret is then judiciously offset laterally with respect to the axis of rotation of this turret, on the same side as the power unit, so as to be in line therewith for transport and not to hinder the raising of the working attachment, which then passes to the side of the cab.

According to another feature of the invention, the working attachment is pivoted on the lower part of the turret, immediately above the slewing gear ring resting on the chassis.

According to yet another feature, the turret is of the type with total rotation so that the working attachment, which may receive for example a loading bucket, an excavating attachment or a crane attachment, as desired, may be slewed in appropriate manner with respect to the chassis.

According to a further suitable feature, the retractable steering wheels of the chassis are mounted on arms pivoted on the turret and able to be positioned by means of hydraulic jacks, these arms being movable between a transport position in which these wheels rest on the ground and a raised position. In this latter position, the steering wheels then suitably occupy a position which does not interfere with the rest of the machine upon total rotation of the turret and the attachments that it supports.

The hydraulic jacks controlling the arms supporting the carrying wheels advantageously communicate with one another in order to effect a compensation of movement when the machine is travelling over uneven ground, in the manner of rocking axles.

According to a further feature, these retractable wheels are mounted to rotate on their support so as to serve as steering wheels for the machine during transport.

The invention will be more readily understood on reading the following description with reference to the accompanying drawings, in which.

Figure 1:
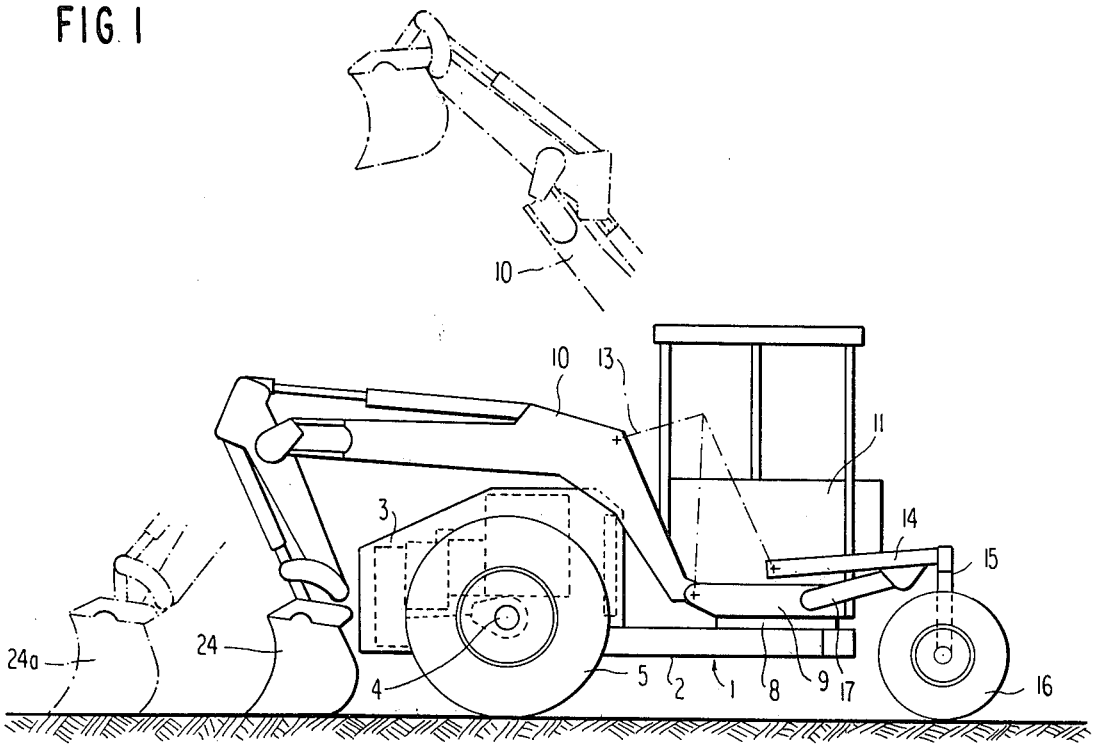
FIG. 1 is an elevation view of an embodiment of a multi-valent excavating and load handling machine according to the invention, the machine being shown here when working as a loader.

Referring now to the drawings, the machine shown in the figures comprises a chassis generally designated by reference numeral 1, comprising here two longitudinal members 2 connected together to form a rigid assembly.

Figure 2:
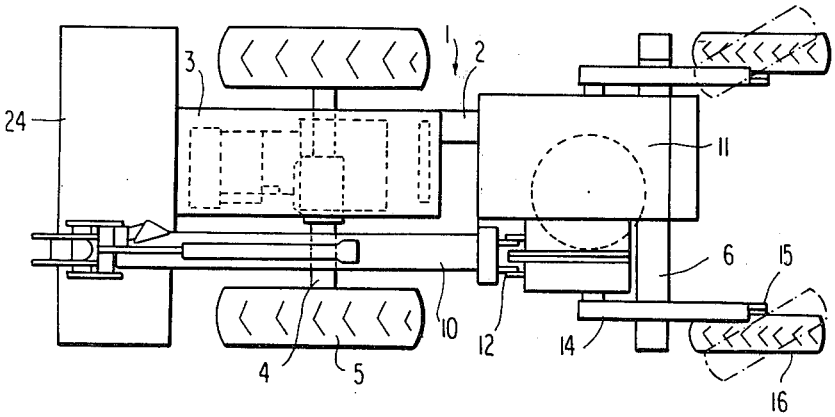
FIG. 2 is a plan view corresponding to FIG. 1.
Figure 4:
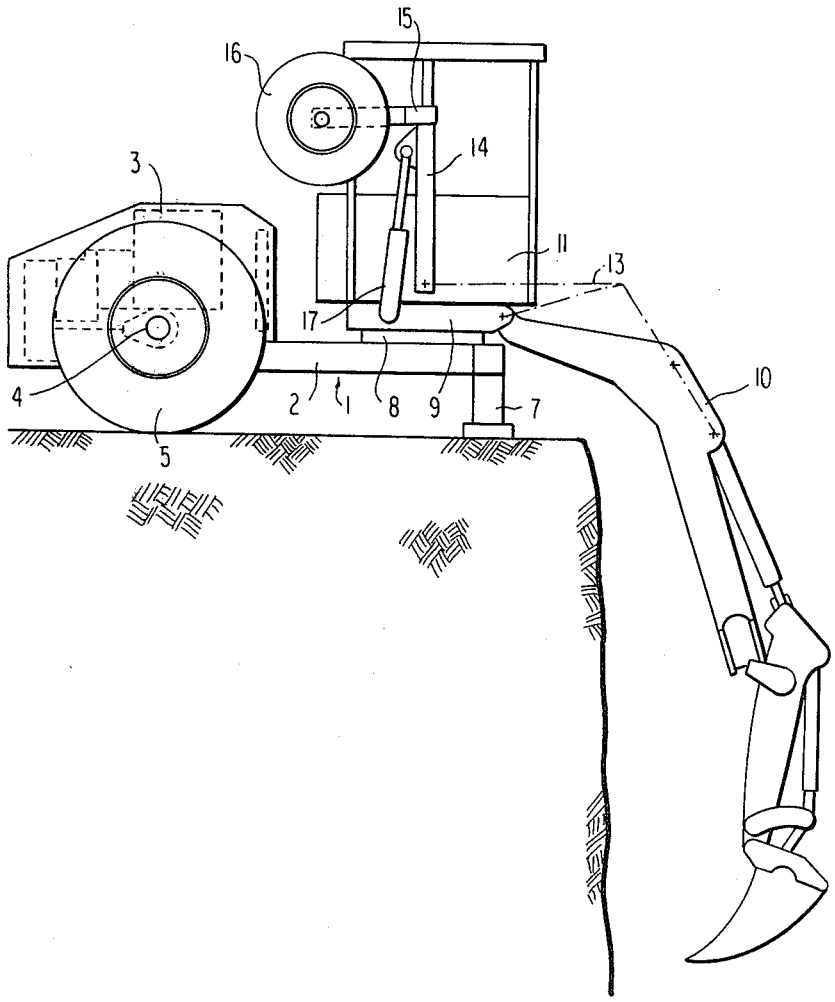
FIG. 4 is a view similar to FIG. 1, but showing the machine working as an excavator or a crane.

This chassis 1 carries at its front end an engine-gear box assembly which may be of conventional type, here designated by reference numeral 3. This assembly is offset laterally with respect to the longitudinal axis of the chassis 1, as may be seen in FIG. 2. The chassis 1 carries towards the same end a driving axle 4 driven by the assembly 3 and equipped with large-dimensioned driving wheels, indicated at 5. FIGS. 1, 2 and 4 show that the dimensions of the engine-gear box assembly 3 in length corresponds approximately to those of the driving wheels 5.

At its rear end, the chassis 1 is provided with a cross-piece 6 (FIG. 2) having a length greater than the width of the chassis and corresponding substantially to the total dimensions of the machine in width, to increase the stability, this cross-piece 6 carrying at its ends retractable stabilizers 7 which may be of any suitable type.

The chassis 1 also carries at its rear end, via a slewing gear ring 8, a turret generally designated by reference 9. This turret carries the working attachment 10 and the cab 11.

As may be seen in FIG. 2, the cab 11 is offset laterally with respect to the axis of rotation of the slewing gear ring 8, so as to be in line with the engine when in position "highway", and the working attachment 10 is pivoted on the turret 9 at a point 12 which is located to the side of the cab and which is consequently offset laterally with respect to the axis of rotation of the ring 8 and consequently with respect to the middle longitudinal plane of the machine, opposite the enginegear box assembly 3 when this working attachment is directed forwardly.

It will be understood that this arrangement allows, in transport position, the lowering of the working attachment 10 to a position in which it is placed to the side of the drive assembly 3, so that it does not hinder the visibility of the driver of the machine when travelling on the highway, and allows the machine to work as a loader. In addition, due to the offset of the cab and of the working attachment, said latter may be raised, during operation, to the side of the cab, thus having a maximum movement in the useful vertical plane, particularly in crane position.

FIGS. 1 and 4 show in particular that the point of articulation 12 of the working attachment 10 on the turret 9 is as low as possible on this turret, this enabling a maximum depth of excavation to be obtained with a given working attachment 13 schematically indicates the system of pivoted levers with control jack which is provided for controlling the movement of the working attachment in the vertical plane. This system, constituted by two pivoted levers and a control jack, is known per se and does not need to be described here in greater detail.

On either side of the turret 9, arms 14 are pivoted in two vertical planes parallel to the plane of symmetry of said turret, said arms carrying at their ends supports 15 receiving steering wheels 16. Jacks 17, mounted between the arms 14 and the turret 9, allow these arms and consequently the wheels 16 to be positioned upwardly or downwardly.

Figure 3:
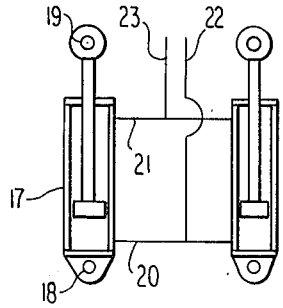
FIG. 3 is a detail view showing the communication between the jacks controlling the arms carrying the retractable wheels.

According to a particular feature of the invention, and as shown in FIG. 3, the jacks 17 which are of the double acting type, are connected to one another.

FIG. 3 indicates, at 18, the lower points of attachment of the bodies of the jacks 17 on the turret 9 and, at 19, the points of attachment of the piston rods of these jacks on the arms 14. The chambers of the jacks communicate together by conduits 20 and 21, which are connected by conduits 22, 23 to a suitable hydraulic source. It will be readily understood that, when the machine is travelling over uneven ground, this communication between the jacks positioning the arms 14 results in a compensation which allows the four wheels to adhere to the ground in the manner of a rocking axle.

The functioning and mode of use of the machine forming the subject matter of the invention are as follows:

In their low position (FIGS. 1 and 2) the steering wheels 16 rest on the ground, so that the machine is supported by these steering wheels 16 and by the front driving wheels 5. In this position, the cab 11 and the attachment 10 are directed forwardly, the turret 9 being locked in this position by any desired means.

For travelling, particularly on the highway, the attachment 10 may, as indicated, be lowered to the side of the drive assembly 3 in order not to hinder the visibility of the driver, and the dimensions of the machine are then minimum. Steering is ensured by means of the rear wheels 16, the unevenness of the ground being compensated by the communication between the jacks 17, as described above.

In this position of the machine, a loading bucket 24 may be mounted at the end of the working attachment 10 (FIGS. 1 and 2). The machine may then work as a loader under very good conditions. In fact, the bucket may be filled by extension of the arm of the working attachment to occupy position **24*a*** for example. Furthermore, due to the design of the working attachment for the excavator and crane function, the height of unloading and the reach are much greater than on conventional backhoe loaders. Finally, contrary to what is the case in these known machines, the load is then supported by the large driving wheels and not by the small steering wheels, this providing a better stability and increasing, further, the adherence of the drive wheels on poor ground.

In the same position of the working attachment, a hook may furthermore be placed at the end of this attachment for transporting and handling heavy loads, with the advantage that these loads are always supported by the large driving wheels.

FIG. 4 shows the machine in a position with steering wheels retracted, in which it may work as excavator or as crane.

In this position, the rear end of the chassis rests on the ground via stabilizers 7 and the arms 14 have been raised virtually to the vertical by means of the jacks 17, this ensuring the retraction of the wheels 16 so as to allow a total rotation of the turret 9 with the cab and the working attachment.

FIG. 4 shows an excavating attachment 10 whose very low point of articulation on the turret 9 makes it possible to attain a maximum depth of working when the machine is working as excavator.

On reading the foregoing description, it is readily appreciated that the machine forming the subject matter of the invention, which is simple to construct, efficiently performs the different functions for its use as excavator and loader. When this machine is working as a loader, it offers considerable possibilities of loading and reach in height, and a good handling ability on all types of ground. For use as excavator, the lowering of the turret to a maximum, as well as the fact of the point of articulation of the attachment being very low, provide a maximum depth of working. The work is then also facilitated by the total rotation of the turret. For handling or working as a crane, the working attachment may be easily adapted, and the work is facilitated by the total rotation of the turret. these results are obtained with a minimum height, as the irreducible dimensions of the cab are increased only by the height of the chassis, and inlength, due to the possiblity of lowering the working attachment to the side of the engine.

These results are also obtained with a simple machine, comprising a single attachment which may work as loader, excavator or crane for handling purposes, simply by adapting the tool corresponding to each function, at the end thereof.

Modifications may be made to the embodiment described, without departing from the scope of the invention.

I claim:

1. a multi-use excavating and load handling machine comprising a chassis, a power unit carried by a forward portion of the chassis and offset laterally with respect to the longitudinal axis of the chassis, driving wheels driven by said power unit and supporting the forward end of the chassis, a slewing gear ring carried by a rear portion of the chassis, a rotatable turret supported by the gear ring for rotation about a vertical axis, a cab carried by the turret, a working attachment carried by the turret, the cab being offset laterally of said axis on the same side as said power unit when the cab faces forward, said working attachment being offset laterally with respect to said axis on the opposite side of said axis from said cab and power unit, and steering wheels supporting the rear of the chassis.

2. A machine as claimed in claim 1, said driving wheels being substantially larger than said steering wheels.

3. A machine as claimed in claim 1 said working attachment being pivoted on the lower part of the turret immediately above said gear ring.

4. A machine as claimed in claim 1, said steering wheels being retractable.

5. A machine as claimed in claim 1, said turret being adapted to rotate 360 degrees about said vertical axis.

6. A machine as claimed in claim 5, said rear wheels being retractable and being mounted on arms pivoted on the turret, and hydraulic jacks for swinging said arms between a transport position in which said steering wheels rest on the ground and a raised position.

7. A machine as claimed in claim 6, said hydraulic jacks communicating with each other to compensate movement of said steering wheels relative to each other when the machine is traveling on uneven ground.

8. A machine as claimed in claim 6, said retractable wheels being mounted for pivotal movement relative to the arms in order to serve as steering wheels for the machine during transport.

* * * * *